US009465333B2

(12) United States Patent
Murakami

(10) Patent No.: US 9,465,333 B2
(45) Date of Patent: Oct. 11, 2016

(54) RECORDING MATERIAL CONVEYING DEVICE AND IMAGE FORMING APPARATUS

(71) Applicant: SHARP KABUSHIKI KAISHA, Osaka (JP)

(72) Inventor: Susumu Murakami, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/601,136

(22) Filed: Jan. 20, 2015

(65) Prior Publication Data

US 2015/0198917 A1 Jul. 16, 2015

Related U.S. Application Data

(62) Division of application No. 13/818,617, filed as application No. PCT/JP2011/062063 on May 26, 2011, now Pat. No. 8,971,731.

(30) Foreign Application Priority Data

Aug. 25, 2010 (JP) ..... 2010-187824

(51) Int. Cl.
*G03G 15/00* (2006.01)
*G03G 15/20* (2006.01)
(Continued)

(52) U.S. Cl.
CPC ..... *G03G 15/2028* (2013.01); *B65H 29/52* (2013.01); *B65H 29/56* (2013.01); *G03G 15/657* (2013.01); *G03G 15/6532* (2013.01); *G03G 15/70* (2013.01); *B65H 2511/528* (2013.01); *G03G 2215/00679* (2013.01)

(58) Field of Classification Search
CPC ..... G03G 15/6532
USPC ..... 399/21
See application file for complete search history.

(56) References Cited

U.S. PATENT DOCUMENTS 4,060,320 A * 11/1977 Doi ..... G03G 15/6532 271/308
4,571,056 A 2/1986 Tani et al.
4,806,966 A * 2/1989 Suga ..... G03G 15/2028 399/323

(Continued)

FOREIGN PATENT DOCUMENTS

CN 1932662 A 3/2007
JP 62-197158 U 12/1987

(Continued)

*Primary Examiner* — Anthony Nguyen
(74) *Attorney, Agent, or Firm* — Birch, Stewart, Kolasch & Birch, LLP

(57) ABSTRACT

A recording material conveying device includes a stripping claw being in contact with one rotary body of a first pair of rotary bodies, and a supporting member supporting a recording material curved when a jam occurs. The supporting member includes a supporting section located more away from the stripping claw than an imaginary straight line (C) passing a nip portion of the first pair of rotary bodies and a surface on a conveying path's side of the stripping claw, and the supporting section supports the recording material curved when the jam occurs. The recording material conveying device further includes a conveyance guide that is disposed on the downstream side from the supporting member and is displaced toward a pressed direction by a pressing force acting when the curved recording material comes into contact with the conveyance guide.

5 Claims, 5 Drawing Sheets

(51) Int. Cl.
*B65H 29/52* (2006.01)
*B65H 29/56* (2006.01)

(56) References Cited

U.S. PATENT DOCUMENTS

| | | | | |
|---|---|---|---|---|
| 4,905,049 | A | 2/1990 | Bickerstaff et al. | |
| 5,068,693 | A | 11/1991 | Nagakura et al. | |
| 5,517,292 | A * | 5/1996 | Yajima | G03G 15/2028 271/900 |
| 6,259,881 | B1 | 7/2001 | Nakamura | |
| 6,526,881 | B2 * | 3/2003 | Iimura | B41L 21/02 101/116 |
| 6,658,229 | B2 | 12/2003 | Ando et al. | |
| 6,785,503 | B2 | 8/2004 | Kuo et al. | |
| 7,251,450 | B2 | 7/2007 | Murakami et al. | |
| 7,299,000 | B2 | 11/2007 | Taira et al. | |
| 7,457,573 | B2 * | 11/2008 | Tsujita | G03G 15/6532 399/315 |
| 7,957,688 | B2 | 6/2011 | Takiguchi et al. | |
| 8,285,182 | B2 | 10/2012 | Aratachi et al. | |
| 8,526,869 | B2 | 9/2013 | Shinkawa et al. | |
| 2007/0059071 | A1 | 3/2007 | Shinshi et al. | |
| 2008/0185762 | A1 * | 8/2008 | Yamamura | B65H 45/20 270/20.1 |
| 2008/0223515 | A1 * | 9/2008 | Sudo | B32B 37/003 156/289 |
| 2011/0285076 | A1 * | 11/2011 | Fujiwara | B65H 29/52 271/186 |

FOREIGN PATENT DOCUMENTS

| | | | |
|---|---|---|---|
| JP | 3-23150 | A | 1/1991 |
| JP | 5-46044 | A | 2/1993 |
| JP | 10-111620 | A | 4/1998 |
| JP | 2000-155493 | A | 6/2000 |
| JP | 2004-170905 | A | 6/2004 |
| JP | 2004-279486 | A | 10/2004 |
| JP | 2010-156771 | A | 7/2010 |

* cited by examiner

FIG.1 "PRIOR ART"

RECORDING MATERIAL CONVEYING DEVICE AND IMAGE FORMING APPARATUS

This application is a Divisional of co-pending U.S. patent application Ser. No. 13/818,617 filed on Feb. 22, 2013, which is a National Phase of PCT/JP2011/062063 filed on May 26, 2011 which claims priority under 35 U.S.C. §119(a) to Patent Application No. JP 2010-187824 filed in Japan on Aug. 25, 2010, all of which are hereby expressly incorporated by reference in their entirety.

TECHNICAL FIELD

The present invention relates to a recording material conveying device provided with a stripping claw that strips a recording material winding on a rotary body such as roller, endless belt and/or the like while the recording material is conveyed off the rotary body, and to an image forming apparatus.

BACKGROUND ART

Among the conventional image forming apparatus are there ones provided with a stripping claw for the purpose of preventing a paper sheet from winding on a rotary body such as photoreceptor drum, fuser roller, transfer belt and so forth that are disposed along a conveying path of the paper sheet onto which an image forming is performed. The stripping claw, typically being disposed facing the rotary body on the downstream side therefrom in the conveying path, strips the paper sheet that winds on the rotary body off the rotary body with its sharp tip.

In the conventional image forming apparatus, it has occasionally been experienced that the paper sheet bends sharply and thereby presses the stripping claw when a jam (paper jam) occurs on the downstream side from the rotary body at which the stripping claw is installed in the conveying path. And such an occurrence has caused a problem of damaging the rotary body due to the sharp tip of the stripping claw pressed against the rotary body.

In dealing with such a problem, a fuser unit has been proposed hitherto in which a movable part of a paper sheet conveyance guide moves to expand a space inside the conveying path when a paper sheet bending sharply due to a jam comes into contact with the conveyance guide with a load greater than normal.

With the fuser unit, because of the expansion of the space inside the conveying path, a load will not work on the stripping claw even when the paper sheet bends sharply. As a result, it is possible to prevent the rotary body from being damaged (refer to Patent Literature 1).

CITATION LIST

Patent Literature

[Patent Literature 1]
Japanese Patent Unexamined Publication No. 5-46044 bulletin

SUMMARY OF INVENTION

Technical Problem

FIG. 1 shows an image forming apparatus applying the configuration described in the above-mentioned Patent Literature 1 to its transfer zone transferring a toner image from its primary transfer belt 6 onto a paper sheet P.

However, with the configuration shown in FIG. 1, it has occasionally been experienced that the rotary body is damaged when a jam occurs during the conveyance of a tough recording material such as paper sheet made of thick paper or the like and thick film.

The reason is that a tough recording material is by nature curved without bending sharply when a jam occurs. That is to say, as shown in FIG. 1, the reason being that as the recording material (paper sheet) P is curved convexly (in the shape of a circular arc) to the stripping claw 21 when a jam occurs in the image forming apparatus the recording material P comes into contact with the stripping claw 21 pressing the stripping claw toughly against the rotary body, thereby causing the sharp tip of the stripping claw 21 to be pressed against the rotary body (the primary transfer belt 6 and a primary transfer belt drive roller 62).

Therefore, the present invention is directed to providing a recording material conveying device of which rotary body will not be damaged even when a jam occurs while a tough recording material is conveyed, and an image forming apparatus.

Solution to Problem

A recording material conveying device of the present invention comprises a first pair of rotary bodies, a stripping claw, a second pair of rotary bodies, a supporting member and a conveyance guide. The first pair of rotary bodies is disposed in a conveying path, and conveys a recording material that has undergone transferring of toners but has not undergone fixing yet. The stripping claw is disposed on the downstream side from the first pair of rotary bodies in the conveying path, and strips the recording material off one rotary body of the first pair of rotary bodies. The second pair of rotary bodies is disposed on the downstream side from the stripping claw in the conveying path, causes the recording material that has not undergone fixing yet to undergo the fixing, and conveys the recording material that has undergone the fixing. The supporting member, being disposed between the stripping claw and the second pair of rotary bodies, includes a supporting section located more away from the stripping claw than an imaginary straight line that passes a nip portion of the first pair of rotary bodies and a surface on the conveying path's side of the stripping claw, and supports with the supporting section the recording material curved at the time of and caused by an occurrence of jam that stops the recording material from being conveyed before its reaching the second pair of rotary bodies. The conveyance guide, being disposed between the supporting member and the second pair of rotary bodies along the conveying path in such a manner as to face one face of the recording material being conveyed onto which face the toners have been transferred, is displaced toward a pressed direction by pressing force acting on the conveyance guide when the recording material curved at the time of the occurrence of jam comes into contact with and thereby presses the conveyance guide. The conveyance guide is a platelike elastic body, of which edge portion on the upstream side in the conveying path is a fixed edge that is fixed to a main body whereas of which edge portion on the downstream side in the conveying path is a free edge, and is supported at an angle by which it is kept from coming into contact with the face of the recording material being conveyed onto which face the toners have been transferred, at the time when the jam does not occur.

When a jam (paper jam) occurs on the downstream side from the first pair of rotary bodies at which the stripping claw is disposed in the conveying path while a tough recording material such as thick paper is conveyed, a front edge portion of the recording material stops due to the paper jam. However, a rear edge portion of the recording material keeps on being conveyed by the first pair of rotary bodies. As a result, the tough recording material is occasionally curved convexly (in the shape of a circular arc) to the stripping claw without bending sharply. When the tough recording material is curved and thereby comes into contact with the stripping claw, the recording material passes on a path that is approximately the same as the imaginary straight line that passes the nip portion of the first pair of rotary bodies and the surface on the conveying path's side of the stripping claw.

With this configuration, the conveyance guide is supported at the angle by which it is kept from coming into contact with the face of the recording material being conveyed onto which face the toners have been transferred, at the time when the jam does not occur. And when the tough recording material is curved at the time of the occurrence of jam and thereby the face of the recording material being conveyed onto which face the toners have been transferred comes into contact with the conveyance guide that is disposed facing the face, the curved recording material comes into contact with and thereby presses the conveyance guide as the rear edge portion of the recording material keeps on being conveyed. At this time, because the conveyance guide is displaced toward the pressed direction and thereby expands a space in the conveying path, the recording material is permitted to be curved within the expanded space, which makes it possible to prevent the recording material from pressing the stripping claw. When the rear edge portion of the recording material keeps on being conveyed, the curved recording material comes into contact with the supporting section of the supporting member, and the recording material is supported by the supporting section. When the rear edge portion of the recording material further keeps on being conveyed, the recording material is curved at its portion facing the stripping claw concavely to the stripping claw. That is to say, the recording material is curved sigmoidally between the first pair of rotary bodies and the second pair of rotary bodies with the supporting section acting as a fulcrum.

On the other hand, when the tough recording material is curved at the time of the occurrence of jam and thereby comes into contact with the supporting section of the supporting member, the recording material is supported by the supporting section. Since the supporting section is located more away from the stripping claw than the above-mentioned imaginary straight line and therefore supports the recording material before the recording material is curved to the extent that it passes on the imaginary straight line, the recording material will not come into contact with the stripping claw. Here, it is preferable that the conveyance guide is disposed either at a position where it comes into contact with the recording material simultaneously with the time when the recording material comes into contact with the supporting section or at a position where it comes into contact with the recording material when the recording material is curved further than coming into contact with the supporting section.

When the rear edge portion of the recording material keeps on being conveyed, the curved recording material comes into contact with the conveyance guide, thereby pressing the conveyance guide. At this time, because the conveyance guide is displaced toward the pressed direction and thereby expands the space in the conveying path, the recording material is permitted to be curved within the expanded space, which makes it possible to prevent the recording material from pressing the stripping claw.

When the rear edge portion of the recording material keeps on being conveyed at the time of the occurrence of jam, because the recording material is stopped at its front edge portion, supported by the supporting section of the supporting member and curved within the space expanded by the displacement of the conveyance guide, the recording material is curved at its portion facing the stripping claw concavely to the stripping claw. In other words, the recording material is curved sigmoidally between the first pair of rotary bodies and the second pair of rotary bodies with the supporting section acting as the fulcrum.

Thus, when a jam occurs while the tough recording material is used, because the recording material is permitted to be curved toward a direction of its leaving from the stripping claw, it is made possible to prevent the recording material from pressing the stripping claw. Also, even when the rear edge portion of the recording material is conveyed further, because the recording material is curved toward the direction of its leaving from the stripping claw, it is made possible to prevent the recording material from pressing the stripping claw.

In the above-mentioned configuration, the conveyance guide is a platelike elastic body, of which edge portion on the upstream side in the conveying path is a fixed edge that is fixed to a main body whereas of which edge portion on the downstream side in the conveying path is a free edge.

If a configuration were such that the conveyance guide were fixed on its downstream side in the conveying path and were capable of being displaced on its upstream side in the conveying path, then the movable edge portion of the conveyance guide would result in being located in the neighborhood of the supporting member, and because the curved recording material would be supported by the supporting member, a neighborhood of a supported portion of the recording material would not be curved much; so that it would not come into contact with the conveyance guide. Because the recording material is likely to be curved at a portion to some extent remote from the portion supported by the supporting member, and because the portion likely to be curved would come into contact with a neighborhood of the fixed edge of the conveyance guide, the conveyance guide would not be deformed much even when it is pressed by the recording material; so that curvature of the recording material could not be absorbed. Therefore, there is a risk that the recording material would be curved in the neighborhood of the stripping claw and thereby press the stripping claw. However, with the present configuration, since the portion of the recording material likely to be curved comes into contact with a neighborhood of the free edge of the conveyance guide on the downstream side in the conveying path, the conveyance guide is displaced when it is pressed by the recording material, thereby being capable of absorbing the curvature of the recording material. Thus, it is made possible to prevent the recording material from pressing the stripping claw, thereby protecting the rotary body against damage.

In the above-mentioned configuration, the recording material conveying device comprises a detecting section and a control section. The detecting section detects displacement of the conveyance guide. The control section, upon the detecting section's detecting the displacement of the conveyance guide, stops the conveyance of the recording material by the first pair of rotary bodies and the second pair of rotary bodies.

With this configuration, when the conveyance guide is displaced, the conveyance of the recording material is stopped. At the time when the recording material coming into contact with the conveyance guide presses the conveyance guide and thereby the conveyance guide starts being displaced, the recording material is not pressing the stripping claw yet. Therefore, stopping the conveyance of the recording material at this point can make it certain that the recording material is prevented from pressing the stripping claw.

An image forming apparatus of the present invention comprises a recording material conveying device configured as described above and an image forming section. The image forming section forms an image onto a recording material that the recording material conveying device conveys.

With this configuration, the stripping claw will not be pressed by the recording material even when a jam occurs; therefore, because damage to the rotary body by the stripping claw will not occur, the rotary body will not cause damage to the recording material nor to an image on the recording material; thereby an image of good quality can be formed.

Advantageous Effects of Invention

The present invention makes it possible to prevent a stripping claw from being pressed by a recording material and hence from causing damage to a rotary body at the time of an occurrence of jam of a tough recording material.

DESCRIPTION OF EMBODIMENTS

Figure 1:
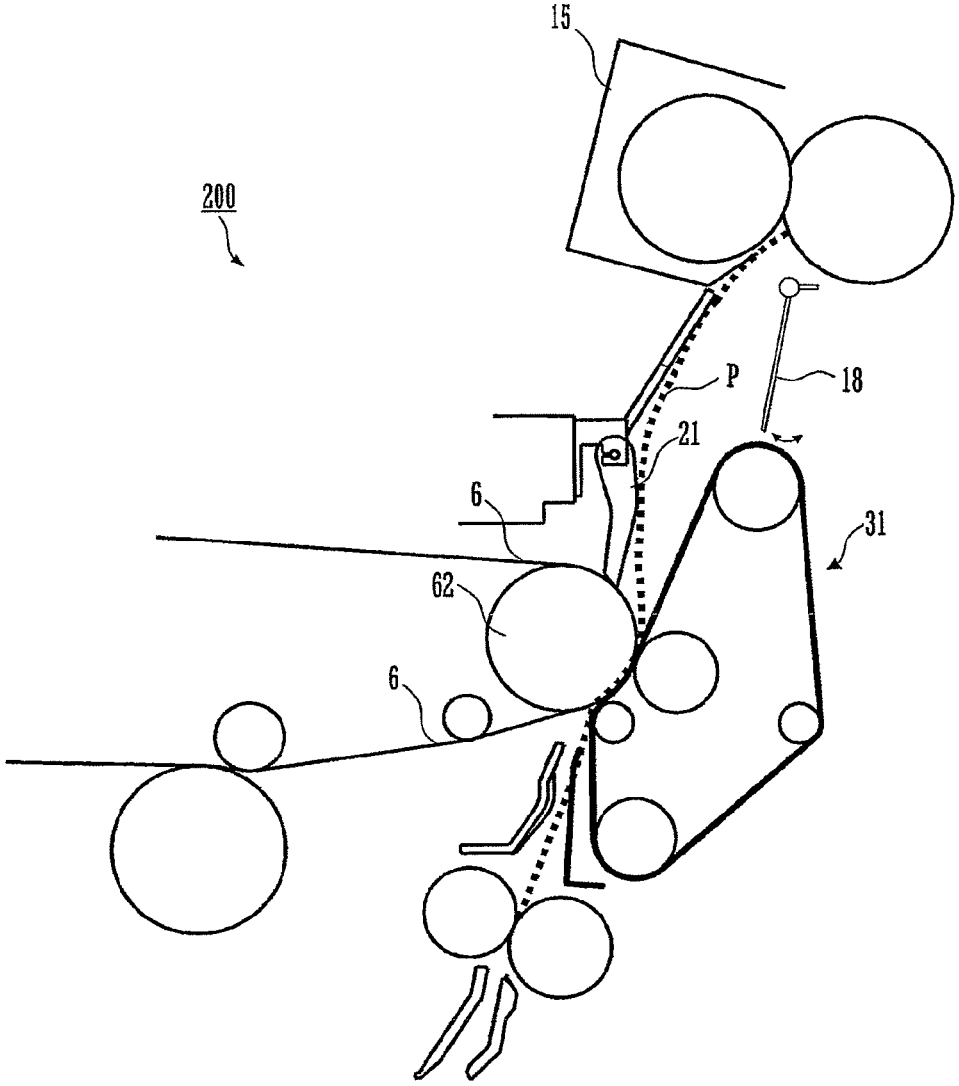
FIG. 1 is a configuration diagram of an image forming apparatus making use of a conventional recording material conveying device.
Figure 2:
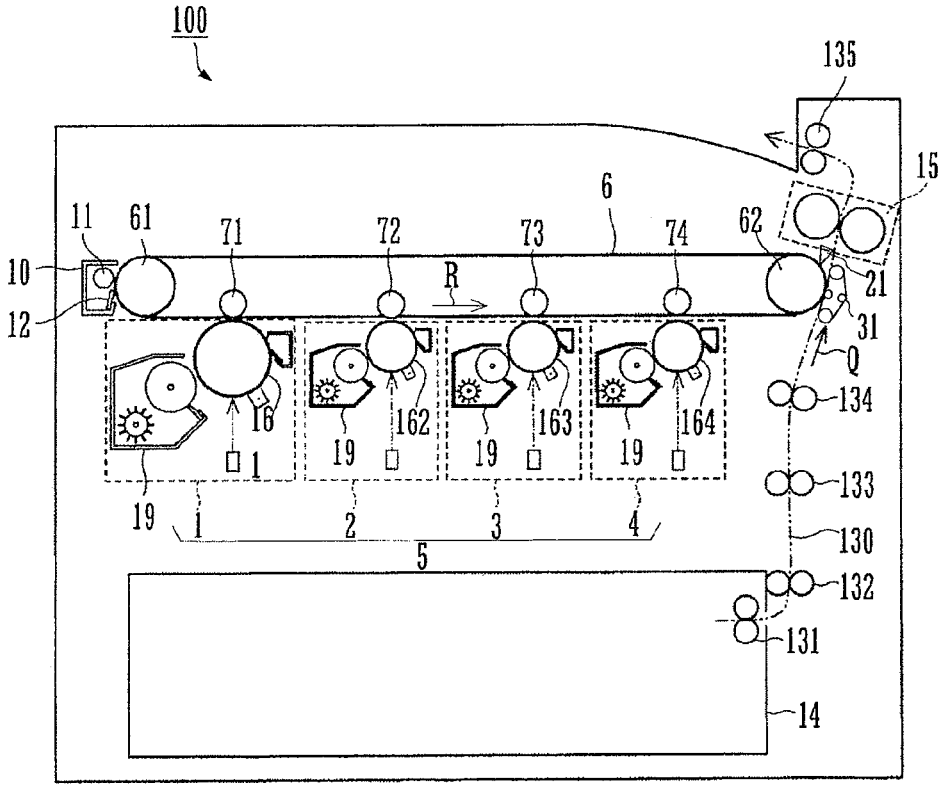
FIG. 2 is a configuration diagram of an image forming apparatus according to an embodiment of the present invention.

A general configuration of a recording material conveying device according to an embodiment of the present invention and an image forming apparatus 100 comprising the recording material conveying device is explained, referring to FIG. 2. Here, in the image forming apparatus 100 are assigned the same signs to the same configurations that are the same as those in an image forming apparatus 200 shown in FIG. 1.

The image forming apparatus 100 is a tandem-type color image forming apparatus including a first image forming unit 1 to form a yellow toner image, a second image forming unit 2 to form a magenta toner image, a third image forming unit 3 to form a cyan toner image, and a fourth image forming unit 4 to form a black toner image. Hereinafter, the four image forming units that the image forming apparatus 100 includes are collectively referred to as the image forming unit group 5.

In FIG. 2, above the image forming unit group 5 is disposed a primary transfer belt (endless belt) 6. The primary transfer belt 6 is passed over a support roller 61 and a primary transfer belt drive roller 62 with tension in the shape of loop, and rotates in a direction shown by an arrow R. For the primary transfer belt 6, resin such as polyimide or polyamide etc. that includes some electronically conductive material and is formed into a shape of a thin film is used.

The image forming unit group 5 is disposed along the primary transfer belt 6 in order of the first image forming unit 1, the second image forming unit 2, the third image forming unit 3, and the fourth image forming unit 4 in the direction of the arrow R.

On the inner peripheral side of the primary transfer belt 6 are disposed primary transfer rollers 71, 72, 73, 74 that transfer monochromatic toner images respectively formed by the image forming unit group 5 onto the primary transfer belt 6. The primary transfer belt 6 is passed over the primary transfer rollers 71, 72, 73, 74 with tension; and across the primary transfer belt 6, the primary transfer rollers 71, 72, 73, 74 respectively face photoreceptor drums 161, 162, 163, 164 that are installed in the image forming unit group 5. The monochromatic toner images respectively formed by the image forming unit group 5 are sequentially transferred (primary transfer) in such a manner as to be superimposed onto the primary transfer belt 6, thereby being brought into forming a full color toner image. The primary transfer belt 6 which is an image bearing member conveys the toner image that has undergone the primary transfer to a position (secondary transfer position) at which the primary transfer belt drive roller 62 and the undermentioned secondary transfer unit 31 face each other. Hereinafter, in the primary transfer belt 6, the support roller 61's side is referred to as the upstream side, whereas the primary transfer belt drive roller 62's side is referred to as the downstream side.

At the secondary transfer position is disposed a secondary transfer unit 31 facing the primary transfer belt drive roller 62 across the primary transfer belt 6. The full color toner image formed on the primary transfer belt 6 is transferred onto a paper sheet (recording material) P by the electrostatic force at the secondary transfer position at which the primary transfer belt drive roller 62 and the secondary transfer unit 31 face each other. To the primary transfer belt 6 (the primary transfer belt drive roller 62) at the secondary transfer position is installed a stripping claw 21 that strips the paper sheet P off when winding thereof on the primary transfer belt 6 (the primary transfer belt drive roller 62) occurs. The stripping claw 21 is made of resin, for example.

At a position facing the support roller 61 across the primary transfer belt 6 is installed a primary transfer belt cleaning unit 10 that cleans a surface of the primary transfer belt 6. The primary transfer belt cleaning unit 10 includes a belt cleaning brush 11 and a belt cleaning blade 12 that are disposed in such a manner as to be in contact with the primary transfer belt 6, and removes the toners and so forth that remain on the primary transfer belt 6 without being transferred onto the paper sheet P.

In FIG. 2, below the image forming unit group 5 is disposed a tray 14 that receives the paper sheet P. The paper sheet P in the tray 14 is conveyed in a conveyance direction shown by an arrow Q to the secondary transfer position at which the secondary transfer unit 31 faces the primary transfer belt 6 by a plurality of pairs of feed rollers 131 through 134 disposed in the conveying path 130; and then at the secondary transfer position, the full color toner image on the primary transfer belt 6 undergoes the secondary transfer onto the paper sheet P.

The paper sheet P onto which the full color toner image has undergone the secondary transfer is conveyed to a fuser unit 15. Then, the paper sheet P undergoes a fixing of the full color toner image by the fuser unit 15, and is discharged from the image forming apparatus 100 by a pair of paper discharge rollers 135.

Figure 3A:
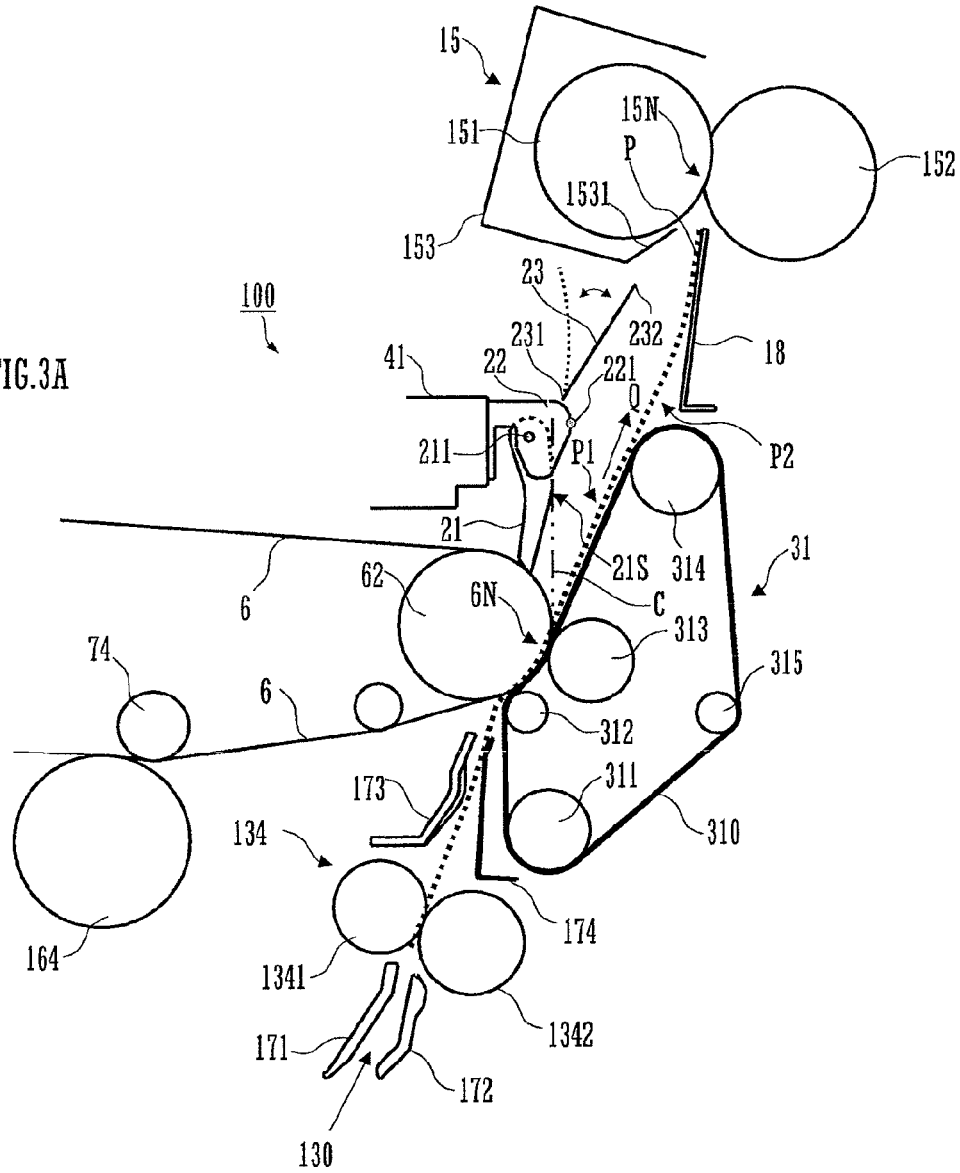
FIG. 3A is a configuration diagram of a recording material conveying device according to an embodiment of the present invention.

Subsequently, a concrete configuration of a part and its periphery that constitute the recording material conveying device is explained. In diagrams from FIG. 3A onward, the paper sheet P is shown by dotted lines. In FIG. 3A, a state is shown in which the image forming apparatus 100 conveys the paper sheet P normally just before a jam occurs. In the following explanation, taking a case of thick paper as an example of a tough recording material, the thick paper is referred to as the paper sheet P.

Although thick paper is generally meant to have a basis weight not less than 90 g/m2, here, a tough paper sheet (thick paper) is meant to be the one having the nature of being curved without bending sharply by a force acting along the surface of the paper sheet when a jam occurs, and having a basis weight of 180 g/m2-230 g/m2, for example.

As shown in FIG. 3A, in the image forming apparatus 100, disposed facing one surface P1 of the paper sheet P conveyed in the conveying path in the direction of the arrow Q are a conveyance guide 171, a roller 1341 of the pair of feed rollers 134, a conveyance guide 173, the primary transfer belt 6 (primary transfer belt drive roller 62), the stripping claw 21, a supporting member 22, a withdrawable conveyance guide 23, a roller cover 153 of the fuser unit 15, and a heating roller 151 of the fuser unit 15 in this order from the upstream side to the downstream side in the conveying path 130. Also, disposed facing the other surface P2 of the paper sheet P are a conveyance guide 172, a roller 1342 of the pair of feed rollers 134, a conveyance guide 174, the secondary transfer unit 31, a conveyance guide 18, and a pressing roller 152 of the fuser unit 15 in this order from the upstream side to the downstream side in the conveying path 130.

The secondary transfer unit 31 includes a secondary transfer belt (endless belt) 310, a support roller 311, an auxiliary secondary transfer roller 312, a secondary transfer roller 313, a secondary transfer belt drive roller 314 and a support roller 315. The secondary transfer belt 310 is passed over the aforementioned respective rollers 311 through 315 with tension in the shape of loop.

The paper sheet P is conveyed in the conveying path 130 by the pair of paper feed rollers 134, the primary transfer belt 6 and the secondary transfer belt 310 which are a first pair of rotary bodies, and the heating roller 151 and the pressing roller 152 of the fuser unit 15 which are a second pair of rotary bodies.

In the image forming apparatus 100, a portion that includes the recording material conveying device comprises the primary transfer belt 6 and the secondary transfer belt 310, the to heating roller 151 and the pressing roller 152 of the fuser unit 15, the stripping claw 21, the supporting member 22, and the withdrawable conveyance guide 23.

Figure 3B:
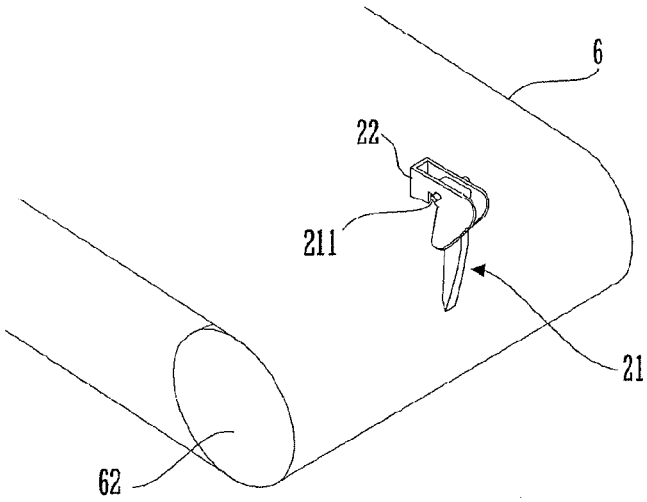
FIG. 3B is a diagram showing a position at which a stripping claw is installed.

As shown in FIG. 3A, the stripping claw 21 is installed to a stripping claw holder 41 in such a manner as to be swingable around a shaft 211, with its tip being lightly in contact with the primary transfer belt 6. In FIG. 3B, an example is shown in which one stripping claw 21 is provided in the middle portion of the primary transfer belt 6. The stripping claw 21 strips the paper sheet P off the primary transfer belt 6 with its tip when the paper sheet P winds on the primary transfer belt 6 while the toner image borne on the primary transfer belt 6 is transferred onto the paper sheet (recording material) P. Here, the more the basis weight is, the less likely it becomes that the paper sheet winds on the primary transfer belt 6; so that a tough paper sheet P will not wind on the primary transfer belt 6.

The supporting member 22 is installed between the stripping claw 21 and the fuser unit 15 (withdrawable conveyance guide 23) along the conveying path 130. The supporting member 22 also serves as the stripping claw holder 41, and its portion facing the conveying path 130 is planar with its corner(s) processed in the shape of arc in order for a jam not to occur when the paper sheet being conveyed comes into contact with it. The supporting member 22 is located at a position that is more away from the stripping claw than an imaginary straight line C shown by the two-dot chain line in FIG. 3A. That is, a portion protruding to a central side of the conveying path 130 and most protruding to the conveying path 130's side from the imaginary straight line C is referred to as the supporting section 221, hereinafter. The supporting section 221 supports the paper sheet P curved when a jam occurs, as described later. The imaginary straight line C is an imaginary straight line that passes a nip portion 6N of the primary transfer belt 6 and the secondary transfer belt 310, and a surface 21S on the conveying path 130's side of the stripping claw 21. The imaginary straight line C is a line simulating a path on which part of the paper sheet P that would be curved in the conveying path 130 and thereby come into contact with the stripping claw 21 would pass if the supporting member 22 were not provided. If the paper sheet P came into contact with the stripping claw 21 and thereby began pressing, the paper sheet P would pass approximately the same path as the imaginary straight line C. Therefore, the present device employs a configuration in which the supporting member 22 is installed in such a manner that the supporting section 221 is located more away from the stripping claw than the imaginary straight line C and thereby so that the paper sheet P is supported by the supporting section 221. This ensures that the supporting section 221 is located more away from the stripping claw 21 than the imaginary straight line C so that it supports the paper sheet P before the paper sheet P is curved to a state of passing on the imaginary straight line C, and hence that the paper sheet P will not come into contact with the stripping claw 21. Therefore, it can be prevented from occurring that the paper sheet P curved due to an occurrence of jam presses the stripping claw 21.

Here, the nip portion is a portion where adjacent rollers are in contact with each other.

The withdrawable conveyance guide 23 is made of a platelike elastic body such as PET (Mylar) or the like, and its one edge portion located on the upstream side in the conveying path 130 is a fixed edge that is fixed to the supporting member 22, whereas its the other edge portion located on the downstream side in the conveying path 130 is a free edge. The withdrawable conveyance guide 23, when pressed by the paper sheet P that comes into contact there-with while being conveyed due to an occurrence of jam, bends (is displaced) in its pressed direction, and returns to its original state when the pressing is released.

Here, it is preferable that the withdrawable conveyance guide 23 is disposed either at a position where it comes into contact with the paper sheet P simultaneously with the time when the paper sheet P comes into contact with the supporting section 221 or at a position where it comes into contact with the paper sheet P when the paper sheet P is curved further. This ensures that the paper sheet P is curved sigmoidally, as described later.

The roller cover 153 jackets environs of the heating roller 151, and its guide section 1531 that guides the paper sheet P to a nip portion 15N is inclined at an angle different from that of the withdrawable conveyance guide 23.

Figure 4A:
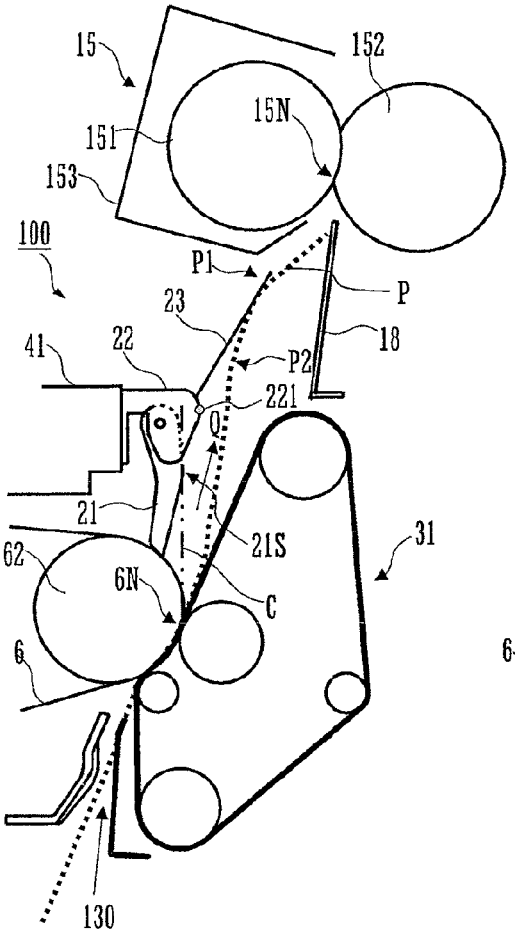
FIGS. 4A, 4B are configuration diagrams showing a state immediately after a jam occurred in the recording material conveying device; with FIG. 4A showing a state of a recording material curved in the shape of letter C, and FIG. 4B showing a state of the recording material curved in the shape of letter S (i.e. sigmoidally).
Figure 4B:
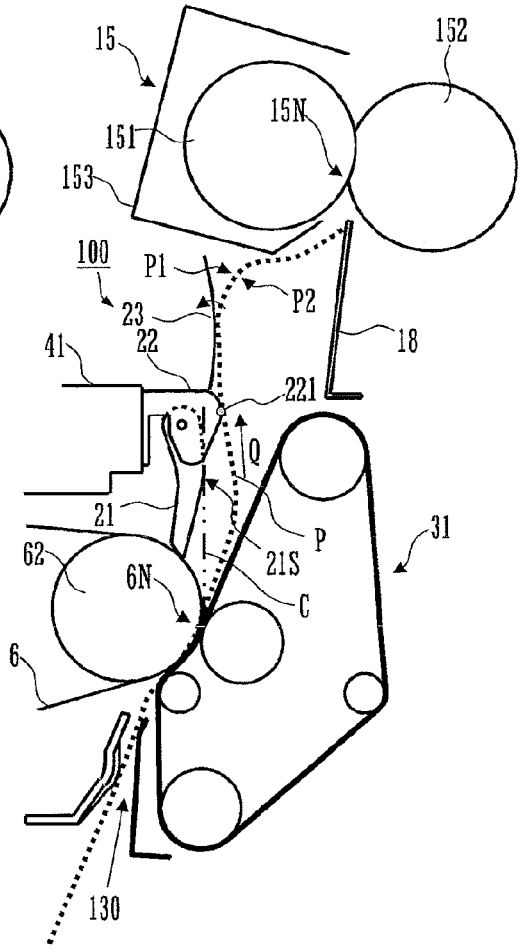

Subsequently, operation at the time of an occurrence of jam at the conveyance guide 18 is explained as an example, referring to FIGS. 4A, 4B. In the following description, a case where a jam occurs at the fuser unit 15 is explained as an example.

In the conveying path 130 for the paper sheet are disposed a plurality of sensors (not shown) to detect a jam, and a control section (not shown) 51 controlling the image forming apparatus 100 monitors outputs from the plurality of sensors.

As shown in FIG. 3A, when a jam (paper jam) occurs in a state where the paper sheet P being conveyed comes into contact with the edge portion on the downstream side of the conveyance guide 18, the paper sheet will never be conveyed to the pair of paper discharge rollers 135 (refer to FIG. 2). When a sensor (not shown) installed in the vicinity of the pair of paper discharge rollers 135 does not detect the paper sheet conveyed thereto upon passage of a predetermined period of time, the control section 51 determines that a jam occurred, and then stops driving of the rollers and belts that convey the paper sheet. In other words, when a jam occurs at the conveyance guide 18, the front edge portion of the paper sheet P stops in the state of being in contact with the conveyance guide 18, whereas the rear edge portion of the paper sheet P keeps on being conveyed by the primary transfer belt 6 and the secondary transfer unit 31 until a predetermined period of time passes; and the conveyance of the paper sheet is stopped after the passage of the predetermined period of time.

In the case where tough thick paper is used as the paper sheet P, the paper sheet P is curved without bending sharply when a jam occurs. As shown in FIG. 3A, when conveyed normally (just before a jam occurs), the paper sheet P is in contact with the secondary transfer belt 310 and the conveyance guide 18. That is to say, there is room to permit the paper sheet P to be curved on its one surface P1's side, whereas there is no such room on the other surface P2's side of the paper sheet P. Therefore, when a jam occurs in the vicinity of the edge portion on the downstream side of the conveyance guide 18, the front edge portion of the paper sheet P stops, whereas the rear edge portion of the paper sheet P keeps on being conveyed. When a jam occurs, the paper sheet P is raised from the side at which the jam occurs, whereas raising at the opposite side is delayed. Further, when the basis weight of the paper sheet P is around 200 g/m2, the delay becomes very little; so that the paper sheet P is raised from the middle portion. The paper sheet P that has been raized is curved in the shape of letter C convexed to the one surface P1's side, as shown in FIG. 4A.

When the paper sheet P is raised from the side where a jam occurred, and if the rear edge portion keeps on being conveyed, the paper sheet P is further curved to come into contact with the withdrawable conveyance guide 23 and thereby presses the withdrawable conveyance guide 23. When pressed by the paper sheet P, a portion of the withdrawable conveyance guide 23 at which the paper sheet P comes into contact with the withdrawable conveyance guide 23 is displaced and curved as shown in FIG. 4B; and because a space in the conveying path 130 expands thereby, the to paper sheet P, being convexed to the surface P1's side, is curved further while pressing the withdrawable conveyance guide 23.

When the rear edge portion keeps on being conveyed, the paper sheet P comes into contact with the supporting section 221, and is supported by the supporting section 221. When the paper sheet P comes into contact with the supporting section 221, its upstream side from the supporting section 221 is curved toward the secondary transfer unit 31's side; so that the paper sheet P is convexed to the secondary transfer unit 31's side. Also, because the paper sheet P is further conveyed on the downstream side from the supporting section 221, the paper sheet P presses the withdrawable conveyance guide 23 and is thereby convexed further (curved further) to the withdrawable conveyance guide 23's side. That is, the paper sheet P becomes a sigmoidal shape bordered by the supporting section 221 which is a contact point.

Further, when the paper sheet P is raised from the middle portion, and if the rear edge portion keeps on being conveyed, the paper sheet P comes into contact with the supporting section 221 of the supporting member 22, and is supported by the supporting section 221. When the rear edge portion keeps on being conveyed, the paper sheet P is further curved to come into contact with the withdrawable conveyance guide 23 and thereby presses the withdrawable conveyance guide 23. When pressed by the paper sheet P, the portion of the withdrawable conveyance guide 23 at which the paper sheet P comes into contact with the withdrawable conveyance guide 23 is displaced and curved as shown in FIG. 4B.

When the rear edge portion keeps on being conveyed, the paper sheet P becomes a sigmoidal shape bordered by the supporting section 221 which is the contact point, in the same manner as in the case where the paper sheet P is raised from the side at which the jam occurred.

In this manner, with the stripping claw 21, the supporting member 22, and the withdrawable conveyance guide 23 respectively provided facing the one surface P1 of the paper sheet P, it is made possible to cause the paper sheet P to be curved sigmoidally; therefore, the paper sheet P can be prevented from pressing the stripping claw 21 even when a jam occurs while a tough paper sheet P is conveyed.

In addition, although the paper sheet P, if being curved sigmoidally, will never press the stripping claw 21 even when the rear edge portion of the paper sheet P is further conveyed, there is a possibility that even a tough paper sheet P may bend sharply if a limit is exceeded and thereby press the stripping claw 21. Therefore, it is recommended to have a setting done beforehand such that the control section 51 detects an occurrence of jam when the paper sheet P is curved to such an extent as shown in FIG. 4B. Also, as will be explained next, it is recommended to set up a configuration in such a manner that the rollers and belts that convey the paper sheet P stop when displacement of the withdrawable conveyance guide 23 is detected.

Additionally, it is when the conveyance force of the nip portion 6N is considerably large that the paper sheet P is raised from the middle portion; whereas if the conveyance force of the nip portion 6N is small, a slip occurs at the nip portion 6N, therefore the paper sheet P is not raised much.

Further, in the case where a configuration is set up in such a manner that the paper sheet P, when conveyed normally, never comes into contact with the secondary transfer belt 310 and the conveyance guide 18, it can happen occasionally that the paper sheet P is curved and convexed to its the other surface P2's side. However, in such case, because the paper sheet P is curved toward a direction of its leaving from the stripping claw 21, the stripping claw 21 will never be pressed. Moreover, with the conveyance guide 18 configured in such a manner as to be displaced when it is pressed by the paper sheet P, because the conveyance guide is displaced in the pressed direction and thereby expands the space in the conveying path even when the paper sheet P is further curved, curvature of the paper sheet P can be absorbed by the expanded space within which the recording material is permitted to be curved, which makes it possible to prevent the paper sheet P from pressing the stripping claw 21.

Subsequently, referring to FIGS. 5A, 5B, the configuration is explained in which the rollers and belts that convey the paper sheet P are stopped when the displacement of the withdrawable conveyance guide is detected.

Figure 5A:
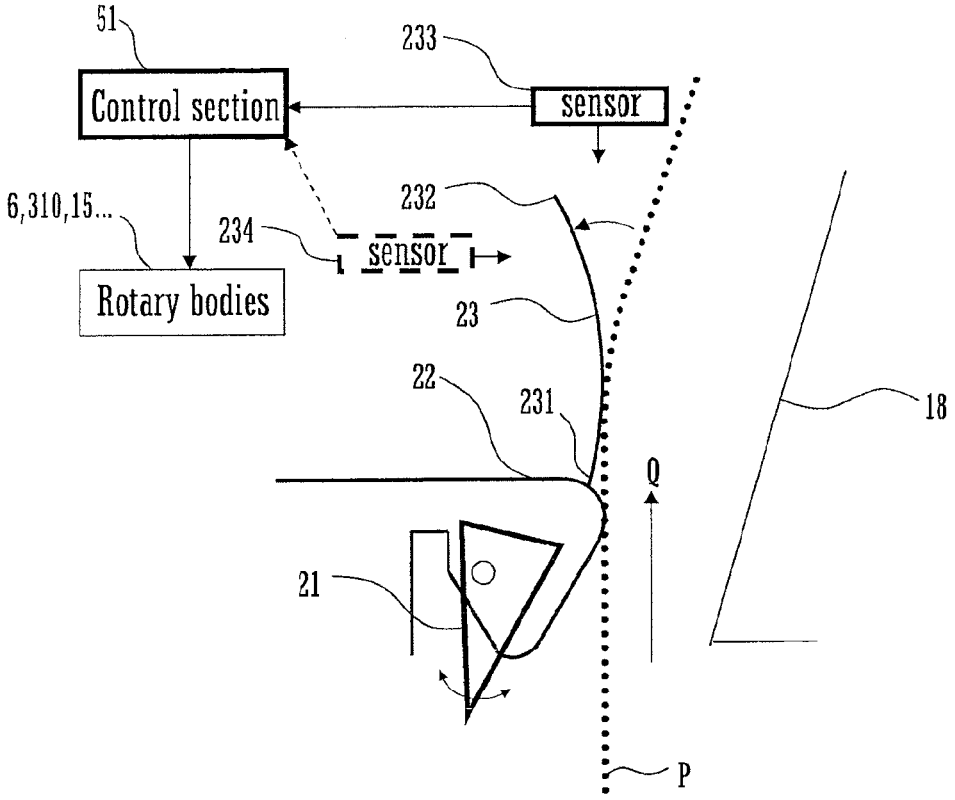
FIGS. 5A, 5B are diagrams explaining a configuration to detect displacement of a withdrawable conveyance guide and thereby to stop the conveyance of the recording material; with FIG. 5A showing a configuration to detect the displacement of the withdrawable conveyance guide, and FIG. 5B showing a configuration to detect a rotation of the withdrawable conveyance guide.
Figure 5B:
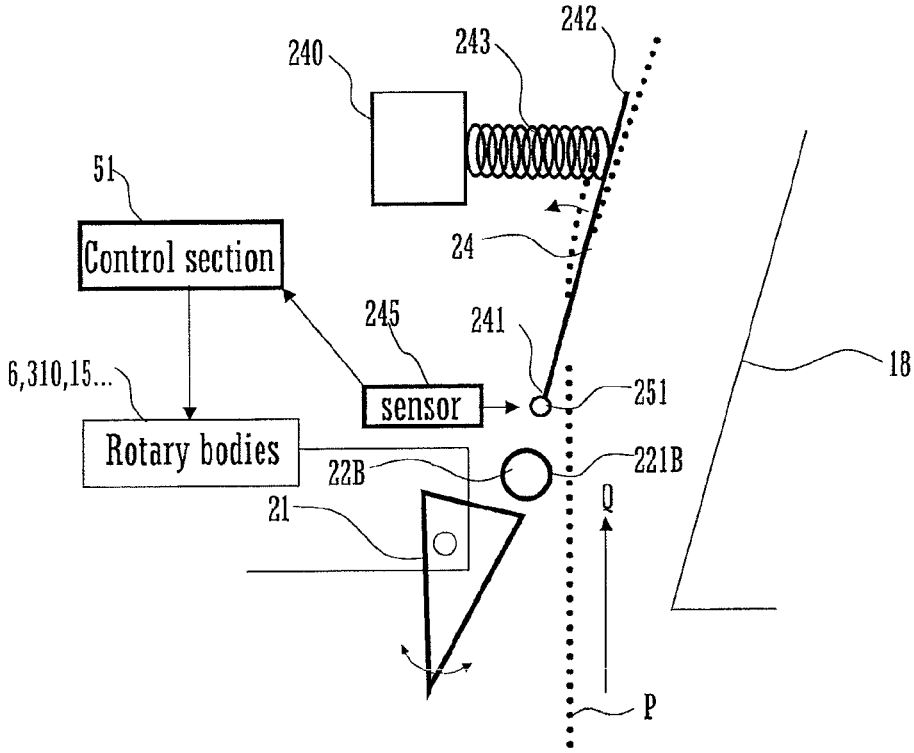

As shown in FIG. 5A, as a detecting section that detects the displacement of the conveyance guide, a sensor 233 is provided facing the free edge 232 of the withdrawable conveyance guide 23. For the sensor 233, an optical displacement sensor is preferred. The sensor 233 is set up so as to output a signal when a rear edge portion of the withdrawable conveyance guide 23 is pressed by the paper sheet P and thereby displaced, and is configured so as to transmit the signal to the control section 51. The control section 51 is configured in such a manner as to cause the rotary bodies conveying the paper sheet P to stop upon detecting that the signal is output from the sensor 233.

This causes the rotary bodies conveying the paper sheet P to stop when the rear edge portion of the withdrawable conveyance guide 23 is pressed by the paper sheet P and displaced thereby; therefore, the paper sheet P is not curved any further, which ensures that the paper sheet P is prevented from pressing the stripping claw 21.

Further, instead of the sensor 233, it is also possible to install a sensor 234 in such a manner as to face one surface of the withdrawable conveyance guide 23 and to configure it so as to detect the displacement of the withdrawable conveyance guide 23.

The withdrawable conveyance guide 23 is not necessarily limited to an elastic body, and a rigid body (member hard to bend) may be used instead. In such a case, it is recommended to set up a configuration as shown in FIG. 5B. That is to say, in the case where a withdrawable conveyance guide 24 is made of a platelike rigid body, an edge portion 241 (upstream side in the conveying path 130) of the withdrawable conveyance guide 24 is fixed to a rotating shaft 251. Further, one end of a spring 243 which is an example of an elastic body is fixed to the proximity of an edge portion 242 (downstream side in the conveying path 130) of the withdrawable conveyance guide 24. The other end of the spring 243 is fixed to a spring fixing part 240 provided in a main body. With such a configuration, the withdrawable conveyance guide 24, like the withdrawable conveyance guide 23, is displaced when pressed by a tough paper sheet P, and returns to its original state when not pressed by the paper sheet P.

With the withdrawable conveyance guide configured as described above, the rotating shaft 251 rotates when the withdrawable conveyance guide 24 is pressed by the paper sheet P. Therefore, even detecting a rotation of the rotating shaft 251 can make it possible to detect that the withdrawable conveyance guide 24 has been pressed by the paper sheet P. That is to say, as shown in FIG. 5B, a sensor 245 that detects a rotation of the rotating shaft 251 is installed in the proximity of the rotating shaft 251. For the sensor 245, a rotary encoder or other sensor detecting a rotation of the rotating shaft is preferred. In the same manner as in the configuration shown in FIG. 5A, a configuration is set up in such a manner that the control section 51, upon detecting that a signal is output from the sensor 234, causes the driving of the rotary bodies such as the primary transfer belt 6 and the secondary transfer belt 310 etc. that convey the paper sheet P to stop. With such a configuration, it is also possible to detect the displacement of the withdrawable conveyance guide 24 and thereby to prevent the paper sheet P from pressing the stripping claw 21.

Additionally, even in the case where the withdrawable conveyance guide 24 is made of a platelike rigid body, it is of course possible to detect the displacement of the withdrawable conveyance guide 24 at the rear edge or the side face thereof, as shown in FIG. 5A.

The supporting member 22 is not necessarily of shape as shown in FIG. 3A; for example, a bar or a cylindrical member may be used instead. Shown in FIG. 5B is an example in which a cylindrical supporting member 22B is disposed. The supporting member 22B, which is a sticklike member longer than the width of the paper sheet P, is installed from this side to the back direction (width direction of the paper sheet P) in FIG. 5B, and supports the curved paper sheet P at a supporting section 221B the paper sheet P comes into contact with.

In this manner, with the supporting member 22 installed on the downstream side from the stripping claw 21 of the primary transfer belt 6 together with the withdrawable conveyance guide 23 installed between the supporting member 22 and the fuser unit 15 along the conveying path 130 in the image forming apparatus 100, even when a jam occurs at the fuser unit 15 while a tough paper sheet as the paper sheet P is used, it is possible to prevent the stripping claw 21 from being pressed by the paper sheet P, and thus to prevent the primary transfer belt 6 and/or the primary transfer belt drive roller 62 from being pressed and thereby damaged by the tip portion of the stripping claw 21.

In addition, although the above explanation has been made about the case where the recording material conveying device of the present invention is installed between a transfer zone and a fixing area, it is not meant to impose such limitations, but the recording material conveying device of the present invention is applicable to any other portion that has a configuration provided with a stripping claw facing a rotary body.

Moreover, although in the above explanation the withdrawable conveyance guides 23, 24 have been indicated as the ones of which edge portions on the upstream side in the conveying path are fixed, it is not meant to limit to such. For example, such a configuration is also possible that a plurality of springs are attached to a withdrawable conveyance guide with both edges thereof left free so that the whole withdrawable conveyance guide is displaced when the paper sheet P comes into contact with and thereby presses the withdrawable conveyance guide.

Further, it is recommended that the withdrawable conveyance guides 23, 24 are configured in such a manner as to guide a recording material instead of being displaced when coming into contact with a weak recording material such as normal paper while it is conveyed and as to be displaced when pressed with a force not less than a predetermined value by a tough paper sheet.

REFERENCE SIGNS LIST

6 Primary transfer belt
6N Nip portion
15 Fuser unit
15N Nip portion
18 Conveyance guide
21 Stripping claw
22, 22B Supporting member
23, 24 Withdrawable conveyance guide
31 Secondary transfer unit
41 Stripping claw holder
51 Control section
61 Support roller
62 Primary transfer belt drive roller
100, 200 Image forming apparatus
130 Conveying path
131-134 A pair of feed rollers
135 A pair of paper discharge rollers
151 Heating roller
152 Pressing roller
153 Roller cover
171-174 Conveyance guide
233, 234 Sensor

The invention claimed is:

1. An image forming apparatus comprising:

an image bearing member;

a stripping claw configured to be in contact with a surface of the image bearing member to strip a recording material off the surface of the image bearing member, a toner image having been transferred onto the recording material;

a conveying path for conveying the recording material stripped off by the stripping claw; and a conveyance guide which is disposed on the stripping claw's side of the conveying path, the conveyance guide including an elastic member which is displaceable by contact with the recording material.

2. The image forming apparatus as claimed in claim 1, wherein the conveyance guide includes a platelike elastic member of which edge portion on an upstream side in the conveying path is a fixed edge fixed to a main body and of which edge portion on a downstream side in the conveying path is a free edge.

3. The image forming apparatus as claimed in claim 1, wherein the conveyance guide is located in such a manner that the conveyance guide is out of contact with a recording material when a paper jam does not occur.

4. The image forming apparatus as claimed in claim 1, further comprising:

a first pair of rotary bodies including the image bearing member;

a second pair of rotary bodies which is disposed on a downstream side from the stripping claw in the conveying path; and a supporting member which is disposed between the stripping claw and the second pair of rotary bodies, the supporting member being located more away from the stripping claw than an imaginary straight line, the imaginary straight line passing a nip portion of the first pair of rotary bodies and a surface on the conveying path's side of the stripping claw, the supporting member supporting the recording material when a paper jam occurs.

5. The image forming apparatus as claimed in claim 4, wherein the second pair of rotary bodies includes a pair of fixing rollers for fixing the toner image on the recording material.

* * * * *